US006450661B1

(12) United States Patent
Okumura

(10) Patent No.: US 6,450,661 B1
(45) Date of Patent: Sep. 17, 2002

(54) LIGHT SOURCE DEVICE USING LIGHT EMITTING DIODE AND LIGHT EMITTING DEVICE USING SAME

(75) Inventor: Masahiro Okumura, Gifu (JP)

(73) Assignee: Kabushiki Kaisha Okumura Seisakusho, Gifu Prefecture (JP)

( * ) Notice: Subject to any disclaimer, the term of this patent is extended or adjusted under 35 U.S.C. 154(b) by 0 days.

(21) Appl. No.: 09/565,841

(22) Filed: May 5, 2000

(30) Foreign Application Priority Data

Nov. 9, 1998 (JP) ..... 10-317555
Feb. 28, 2000 (JP) ..... 2000-51047

(51) Int. Cl.[7] ..... F21V 7/00; F21V 1/04

(52) U.S. Cl. ..... 362/240; 362/297; 362/346; 362/255; 362/249; 362/252; 362/241

(58) Field of Search ..... 362/240, 255, 362/297–301, 303, 311, 351, 360, 361, 800, 806, 809, 249, 250, 252, 238, 241, 243, 346, 349, 555, 559, 560; 84/464 R, 464 A

(56) References Cited

U.S. PATENT DOCUMENTS 5,147,129 A * 9/1992 Ku ..... 362/106
5,249,104 A * 9/1993 Mizobe ..... 362/31
5,319,531 A * 6/1994 Kutnyak ..... 362/184
5,580,156 A * 12/1996 Suzuki et al. ..... 362/184
5,593,223 A * 1/1997 Koizumi ..... 362/255
5,772,312 A * 6/1998 Pihl-Niederman et al. .. 362/249
5,949,346 A * 9/1999 Suzuki et al. ..... 340/815.45
6,002,079 A * 12/1999 Shin et al. ..... 84/464 R

* cited by examiner

*Primary Examiner*—Sandra O'Shea
*Assistant Examiner*—David V. Hobden
(74) *Attorney, Agent, or Firm*—Darby & Darby

(57) ABSTRACT

A light source device including a light-permeable cap accommodating therein a light emitting diode adapted to emit light from a top surface thereof in an axial direction. The top surface is oriented at an angle relative to the axial direction such that the light projected toward the top surface is reflected thereon and is redirected toward lateral direction or directions. A light emitting device has a disc-like globe which has opposing flat light permeable walls and within which a plurality of such light source devices are arranged along a marginal portion of the globe. The redirected light from each light source is diffused from the light permeable walls.

14 Claims, 15 Drawing Sheets

LIGHT SOURCE DEVICE USING LIGHT EMITTING DIODE AND LIGHT EMITTING DEVICE USING SAME

BACKGROUND OF THE INVENTION

This invention relates to a light source device using a light emitting diode and a light emitting device using a plurality of such light source devices. The light emitting device is useful as a signal indicting lamp installed in, for example, in workplace to ensure safety of workers, drivers and pedestrians and as an illuminating lamp or sign for advertising.

Because of their longer service life and smaller energy consumption, light emitting diodes are increasingly used as a substitute for incandescent lamps. Light emitting diodes are thus utilized as a light emitting device, such as a signal indicating lamp or an advertising lamp, having a disc-like globe with opposing light permeable surfaces.

A light emitting diode is generally composed of a light emitting source encapsuled in a transparent bullet-like shell and is designed to emit light mainly in an axial direction. Because of this characteristic of light directivity, a light emitting device disclosed in Japanese utility model publication H01-93209 uses a large number of light emitting diodes disposed in a disc-like globe such that a half of them are oriented toward one surface of the globe with a remainder half being oriented toward the other surface.

To reduce the number of the light emitting diodes, Japanese utility model registration No. 2,579,221 proposes the use of a reflector in a light emitting device having a disc-like globe. The globe has opposing light permeable front and rear walls, and a circumferential side wall disposed between therebetween. A plurality of light emitting diodes are arranged such that light emitted therefrom are projected radially outward, namely toward the cicumferential side wall. A reflecting plate is disposed along an inside wall of the circumferential side wall, so that the light from the light emitting diodes is reflected thereon and redirected toward the light permeable front and rear walls.

The above device can reduce the number of the light emitting diodes, but has a problem that the construction of the globe, reflecting plate and associated parts thereof is complicated. Further, with the above device, it is not possible to use light emitting diodes having various different sizes for obtaining a desired illumination image or design.

SUMMARY OF THE INVENTION

It is, therefore, an object of the present invention to provide a light emitting device which uses a plurality of light emitting diodes and which is simple in construction and which can give high brightness and uniform illumination.

Another object of the present invention is to provide a light emitting device of the above-mentioned type which permits easy changes of an illumination mode or design.

It is a further object of the present invention to provide a light emitting device of the above-mentioned type which can efficiently use a light flux from each light emitting diode.

It is yet a further object of the present invention to provide a light source device using a light emitting diode.

In accomplishing the foregoing objects, there is provided in accordance with the present invention a light emitting device which comprises a disc-like globe including a light permeable first wall, a second wall disposed opposite the first wall, and a circumferential side wall disposed between the first and second walls, and a plurality of light source devices secured within the globe and arranged along a peripheral portion thereof. Each of the light source devices includes:

a light-permeable cap having opposing top and bottom surfaces, opposing first and second surfaces located between the top and bottom surfaces, opposing third and fourth surfaces located between the top and bottom surfaces and between the first and second surfaces, the bottom surface having a concave portion extending toward the top surface; and a light emitting diode accommodated and secured in the concave portion so that a part of light emitted from the diode is projected toward the top surface;

the top surface being a flat surface oriented at such an angle that the light projected toward the top surface is reflected thereon and is redirected toward the first surface, each of the light source devices being disposed so that a light from the first surface of each of the light source devices is projected outwardly from the globe through the light-permeable first wall.

The present invention also provides a light emitting device which comprises a disc-like globe including opposing light permeable first and second walls, and a circumferential side wall disposed between the first and second walls, and a plurality of light source devices secured within the globe and arranged along a peripheral portion thereof. Each of the light source devices includes:

a light-permeable cap having opposing top and bottom surfaces, opposing first and second surfaces located between the top and bottom surfaces, opposing third and fourth surfaces located between the top and bottom surfaces and between the first and second surfaces, the bottom surface having a concave portion extending toward the top surface; and a light emitting diode accommodated and secured in the concave portion so that a part of light emitted from the diode is projected toward the top surface;

the top surface being V-shaped so that the light projected toward the top surface is reflected thereon and divided into two fractions which are redirected toward the first and second surfaces, respectively, each of the light source devices being disposed so that the light fractions from the first and second surfaces of each of the light source devices are projected outwardly from the globe through the light-permeable first and second walls, respectively.

The present invention further provides a light source device which comprises:

a light-permeable cap having opposing top and bottom surfaces, opposing first and second surfaces located between the top and bottom surfaces, opposing third and fourth surfaces located between the top and bottom surfaces and between the first and second surfaces, the bottom surface having a concave portion extending toward the top surface; and a light emitting diode accommodated and secured in the concave portion so that a part of light emitted from the diode is projected toward the top surface;

the top surface being oriented at an angle so that the light projected toward the cut surface is reflected thereon and is redirected toward at least one of the first and second surfaces.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
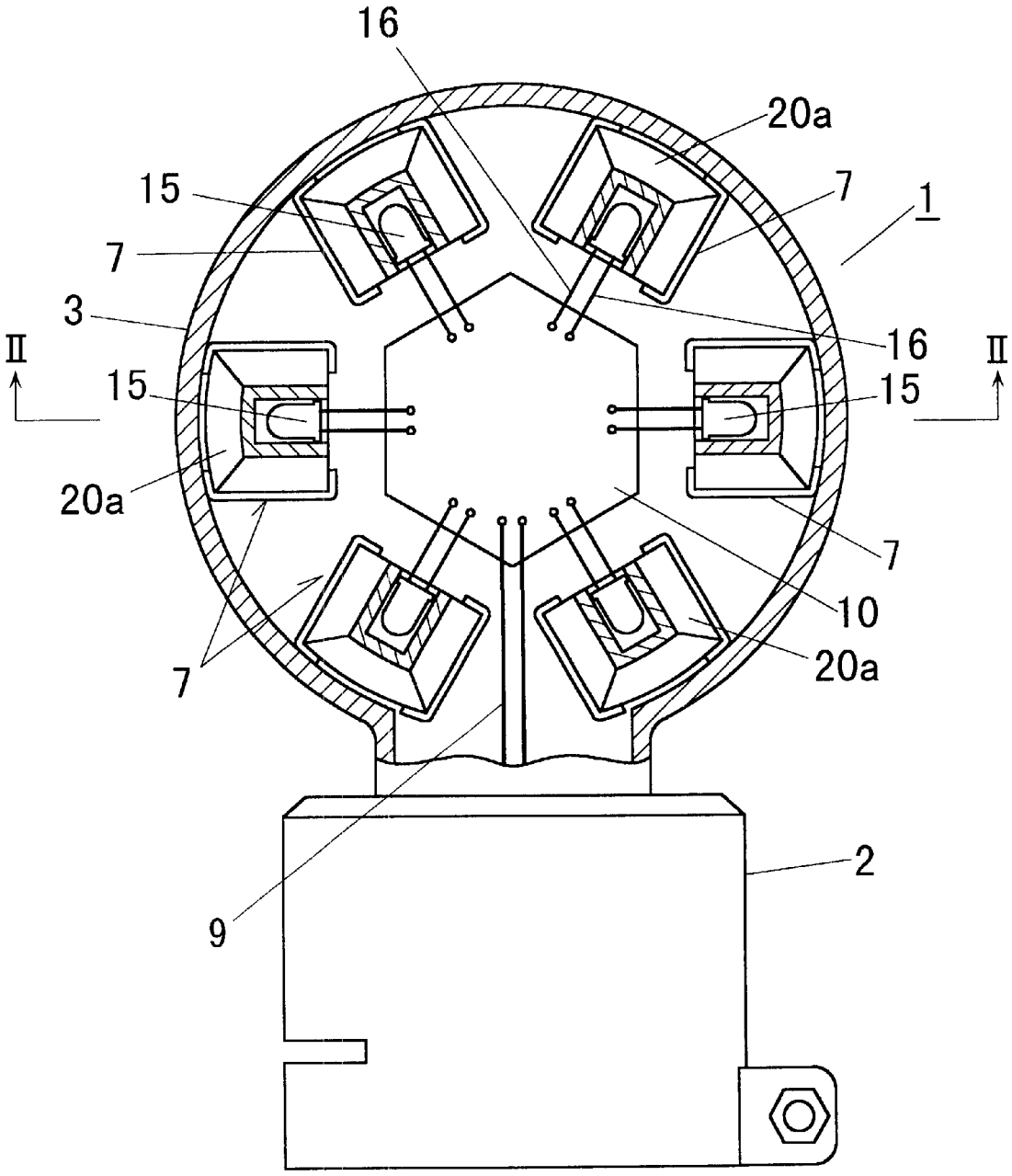
FIG. 1 is an elevational view partly in cross-section showing one embodiment of a light emitting device according to the present invention.
Figure 2:
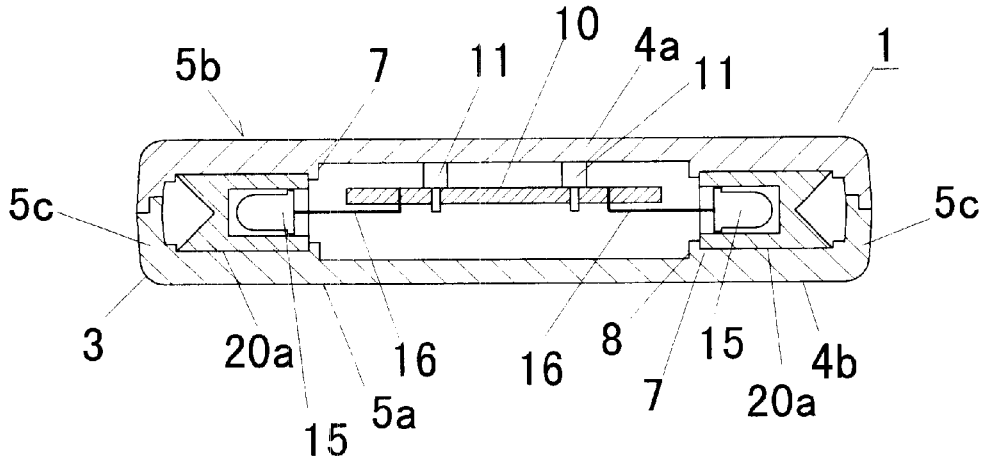
FIG. 2 is a sectional view taken along the line II—II in FIG. 1.

Referring first to FIGS. 1 and 2, designated generally as 1 is a light emitting device according to the present invention to be installed in a workplace. The light emitting device 1 has a mounting bracket or support 2 for use in mounting the device 1 to a pillar in the workplace. Connected to the bracket 2 is a disc-like globe 3 including opposing light permeable first and second walls 5*a* and 5*b*,and a circumferential side wall 5*c* disposed between the first and second walls 5*a* and 5*b*. In the illustrated embodiment, the shape of the globe 3 is circular. However, the globe 3 may have a polygonal or any other desired shape. The globe 3 in this embodiment is composed of two halves 4*a* and 4*b* formed of a transparent material such as an acrylic resin and assembled together to form a space therebetween.

Inside surfaces of the globe 3 is shaped such that a plurality of holders 7 each adapted to receive a light source device 20*a* are defined along a peripheral portion of the globe 3. In the illustrated embodiment, six, angularly equally spaced apart holders 7 are formed within the globe 3. Each light source device 20*a* is fitted into and supported by the corresponding holder 7.

Disposed in a central portion in the inside space of the globe 3 is a printed wiring board 10. The board 10 is secured to protrusions 11 planted on an inside wall of the globe 3. Each light source device 20*a* is provided with a light emitting diode 15 having lead wires 16 extending into through holes of the printed wiring board 10. Lead wires 9 extend from a terminal (not shown) supported by the bracket 2 to the printed wiring board 10 so that each of the light emitting diode 15 is able to be energized by a power source (not shown) electrically connected to the terminal. The light emitting diode 15 has a bullet-like shape with its head transparent resin portion being designed to function as a lens so that light is emitted from the light emitting diode mainly in an axial direction.

Figure 3:
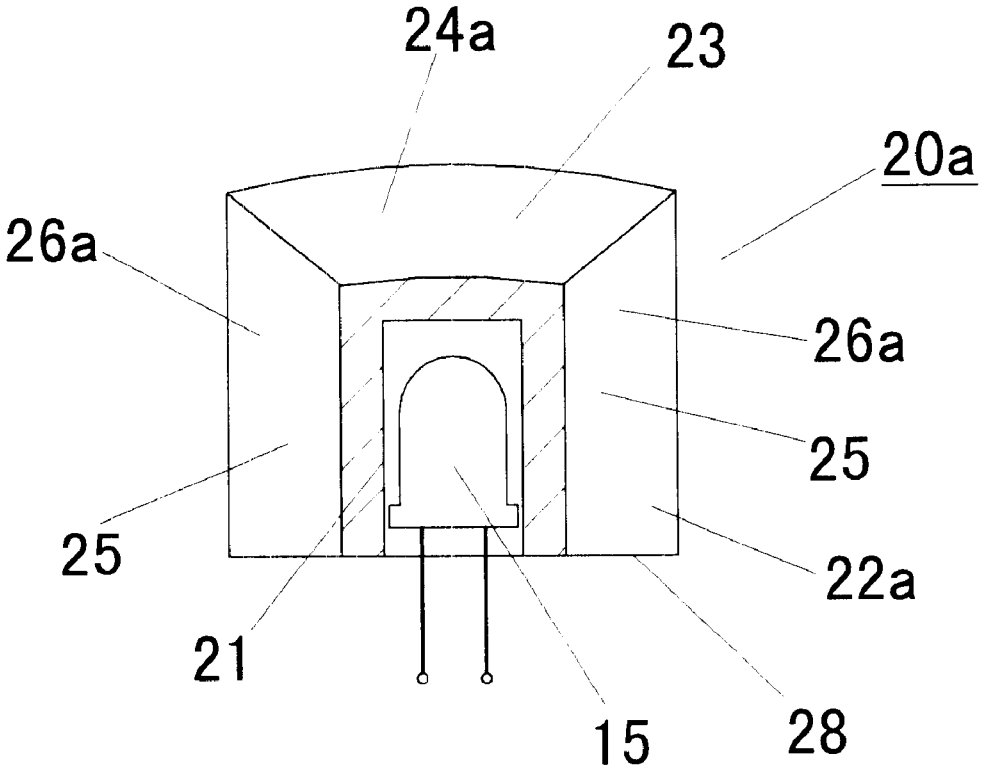
FIG. 3 is an enlarged sectional view of a first embodiment of a light source device of the light emitting device shown in FIG. 1.
Figure 4:
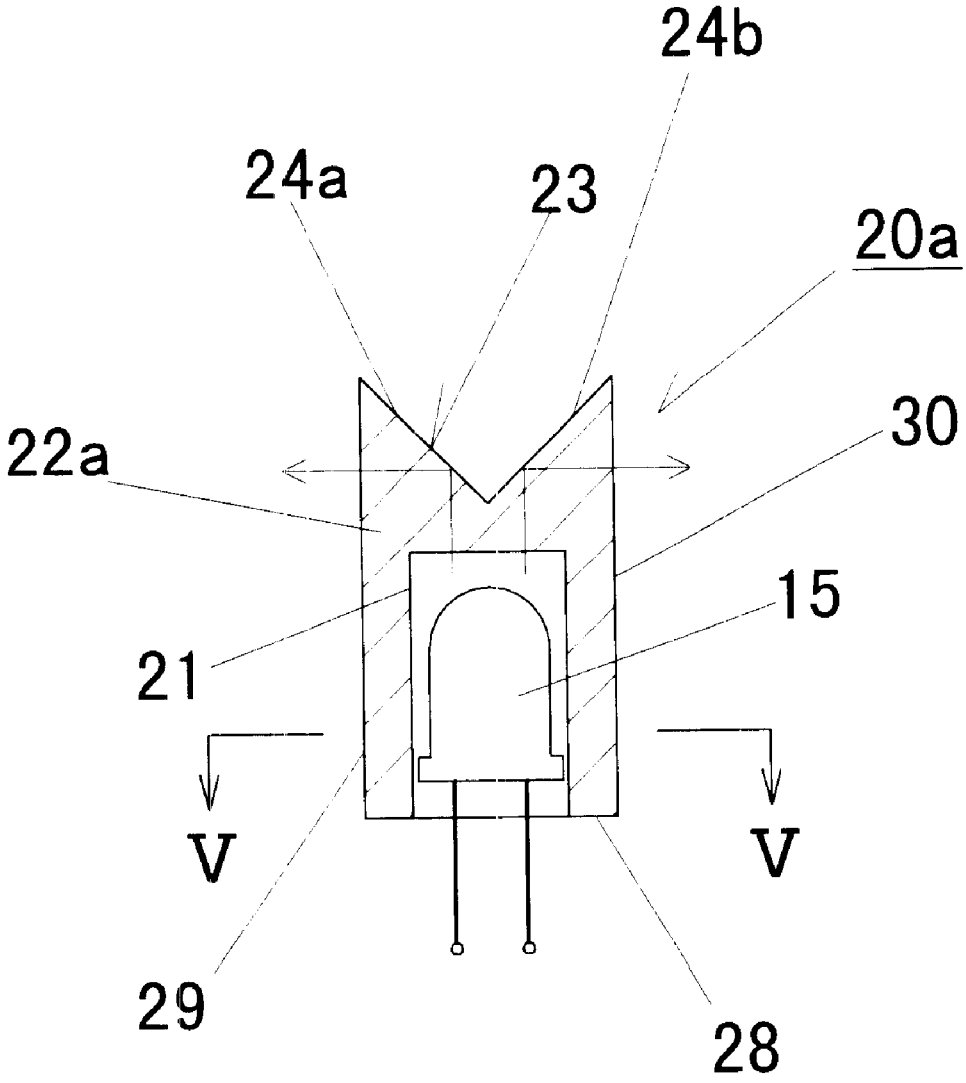
FIG. 4 is an enlarged sectional view of the light source device of the light emitting device shown in FIG. 2.
Figure 5:
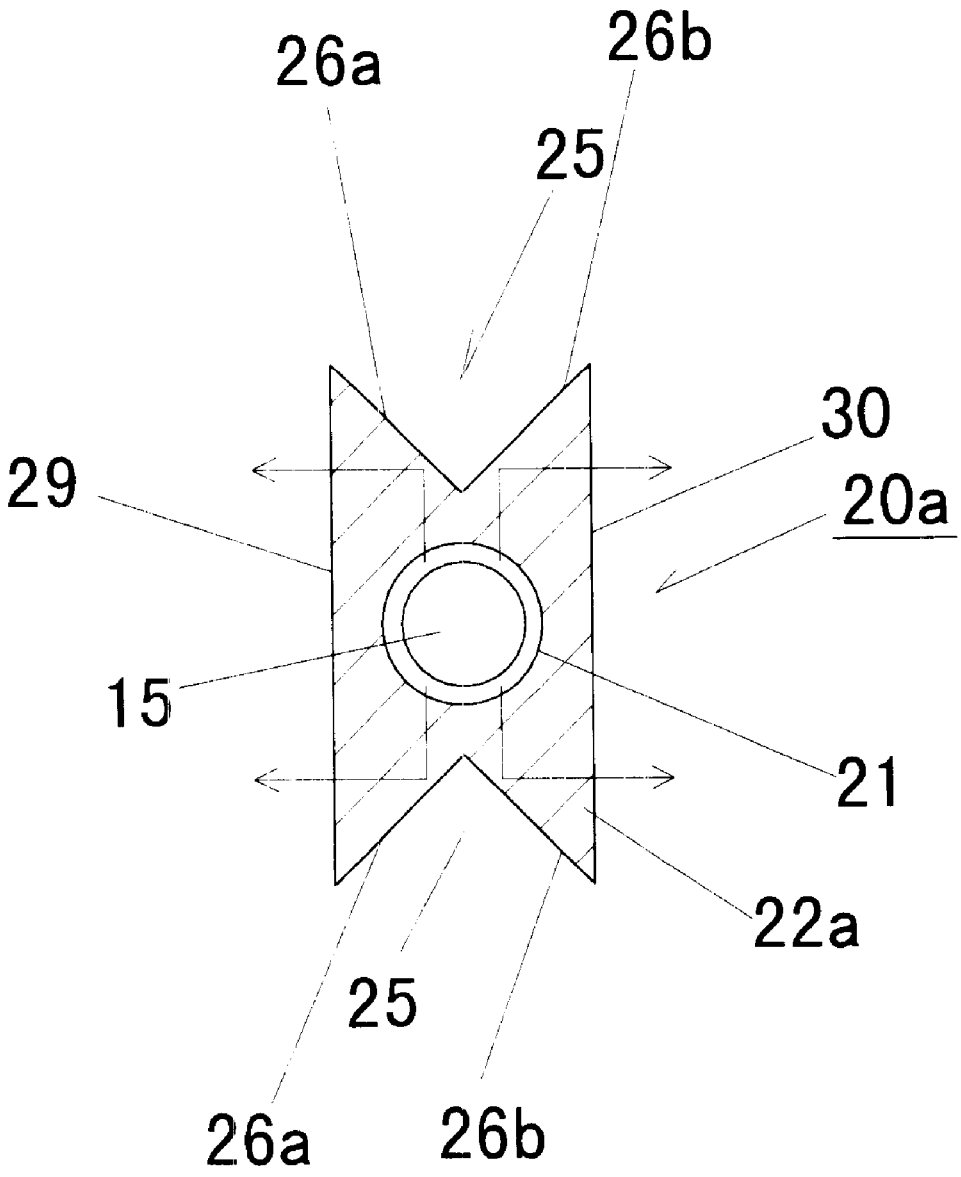
FIG. 5 is a sectional view taken along the line V—V in FIG. 4.

FIGS. 3 through 5 depict a first embodiment of the light source device 20*a* used in the light emitting device shown in FIGS. 1 and 2. The light source device 20*a* has a light-permeable cap 22*a* made of a transparent material such as an acrylate resin. The cap 22*a* has opposing top surface 23 and bottom surface 28, opposing first surface 29 and second surface 30 located between the top and bottom surfaces 23 and 28, opposing third and fourth surfaces 25, 25 located between the top and bottom surfaces 23 and 28 and between the first and second surfaces 29 and 30. The bottom surface 28 has a concave portion 21 extending toward the top surface 23. The cap 22*a* has a size adapted for fitting engagement with the holder 7 defined in the globe 3 (FIGS. 1 and 2).

Disposed within the concave portion 21 is a light emitting diode 15 designed such that a part, generally a majority part, of light emitted from the diode 15 is projected toward the top surface 23, namely in the radially outward of the globe 3 (FIG. 1).

As illustrated in FIG. 4, the top surface 23 is V-shaped and is composed of two sloped surfaces 24*a* and 24*b*, so that the light projected from the light emitting diode 15 toward the top surface 23 is reflected on the sloped surfaces 24*a* and 24*b* and divided into two fractions which are redirected toward the first and second surfaces 29 and 30, respectively. As shown in FIG. 1, each of the light source devices 20*a* is disposed so that the light fractions from the first and second surfaces 29 and 30 thereof are projected outwardly from the globe 3 through the light-permeable first and second walls 5*a* and 5*b*.

Thus, not only light from each light emitting diode 15 projected toward the first and second walls 5*a* and 5*b* of the globe 3, but also light projected in the radial direction of the globe 3 are passed through the first and second walls 5*a* and 5*b*. Therefore, the light strength of the light emitting device is much increased as compared with a case in which such light projected toward radial direction of the globe 3 is not utilized. In addition, because of the presence of the cap 22*a*, the light from the light emitting diode 15 is diffused in wider emission angles. As a consequence, the light projected from the first and second walls 5*a* and 5*b* of the globe becomes uniform.

With the light emitting device as described above, no reflecting plate is mounted in the space in the globe. This permits simple construction of the globe. Moreover, illumination design of the light emitting device can be easily changed without a change of the globe by mere replacement of the caps 22*a* and the light emitting diodes 15.

As shown in FIG. 5, not only the top surface 23 but also each of the third and fourth surfaces 25 of each of the cap 22*a* is V-shaped and is composed of two sloped surfaces 26*a* and 26*b* so that light from the diode 15 projected toward the third and fourth surfaces 25 is reflected on the slopes 26*a* and 26*b* and is divided into two light fractions which are redirected toward the first and second surfaces 29 and 30, respectively. With the cap 22*a* thus constructed, almost of all the light emitted from the diode 15 can be directed towards the first and second surfaces 29 and 30 of the globe 3 and effectively utilized for indication or illumination purposes.

Figure 6:
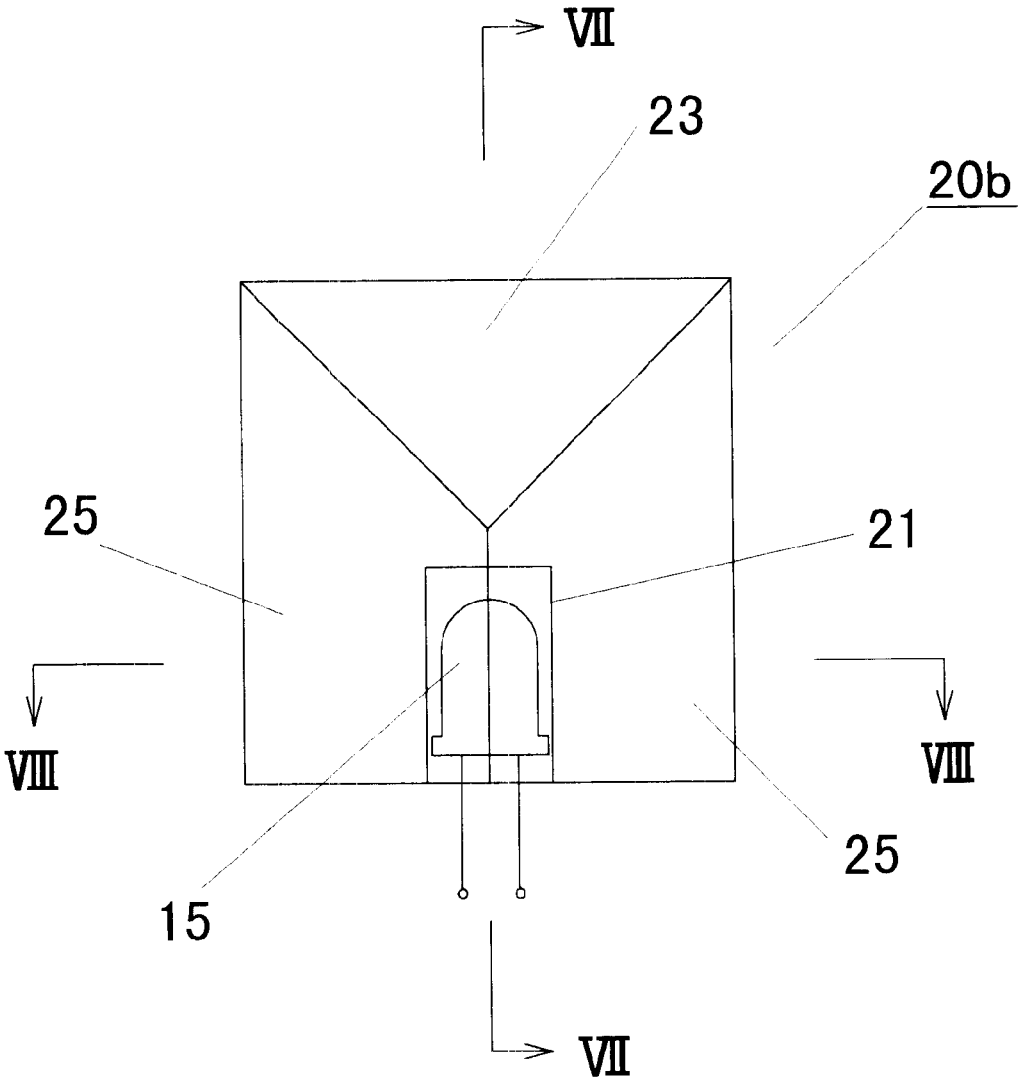
FIG. 6 is an elevational view of a second embodiment of a light source device according to the present invention.
Figure 7:
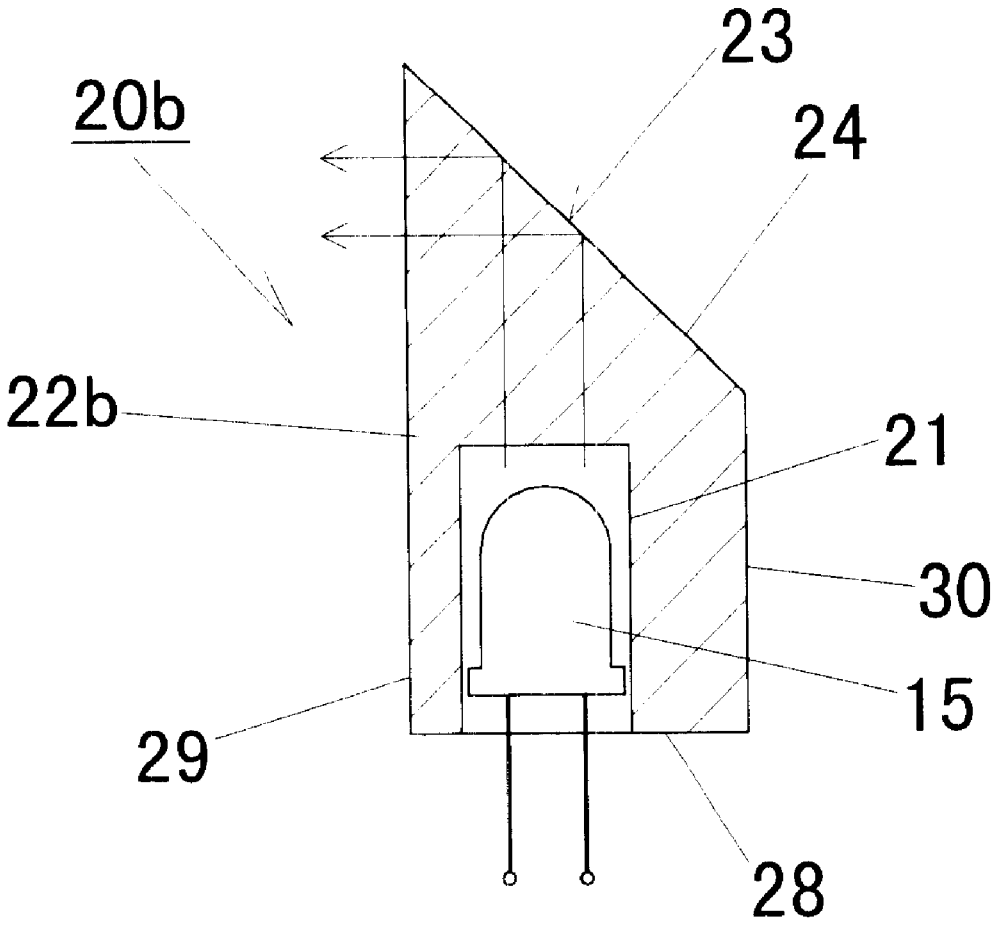
FIG. 7 is a sectional view taken along the line VII—VII in FIG. 6 and corresponding to FIG. 4.
Figure 8:
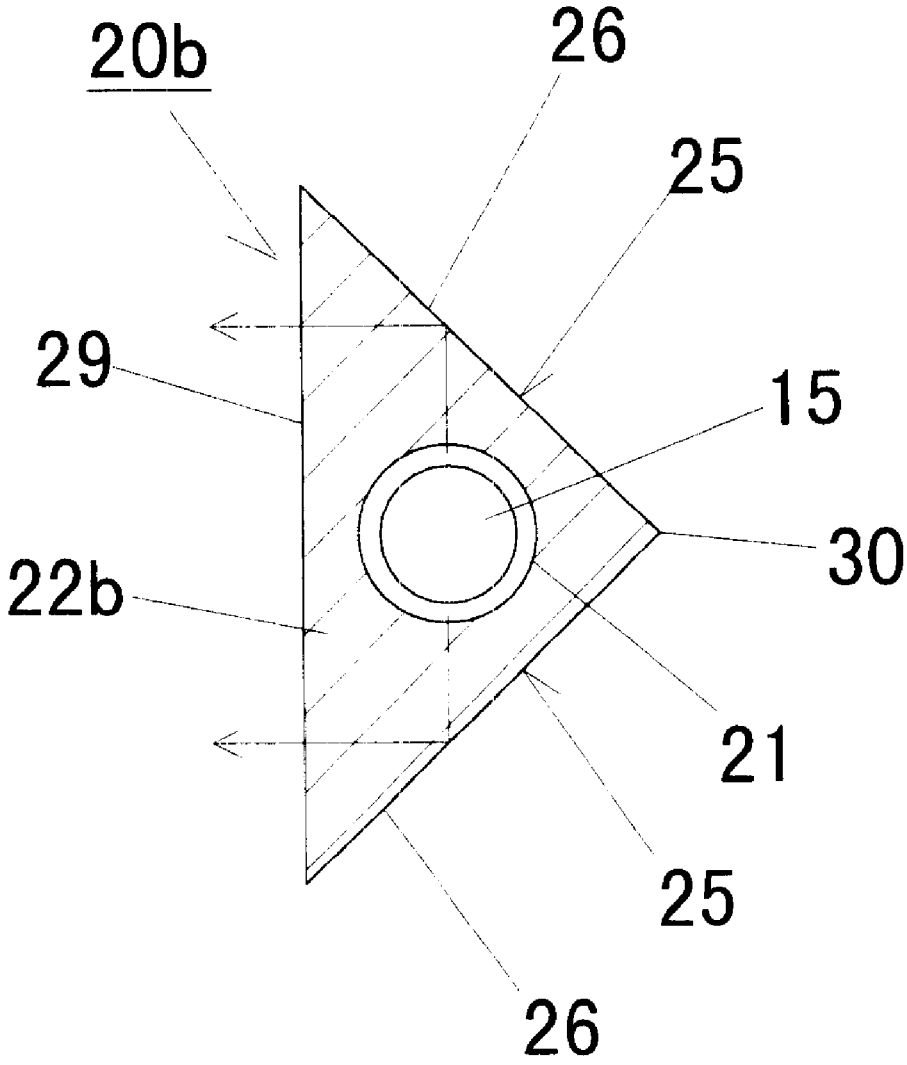
FIG. 8 is a sectional view taken along the line VIII—VIII in FIG. 6 and corresponding to FIG. 5.

FIGS. 6 through 8 show a second embodiment of a light source device 20*b*, in which the same reference numerals as those in FIGS. 3 through 5 designate similar component parts. The second embodiment is utilized for a light emitting device 1 in which only one of the first and second walls 5*a* and 5*b* is utilized for illumination or indication purposes. Namely, there are cases where one of the illumination or indication surfaces 5*a* and 5*b* of the globe 3 is not desired to emit light. The second embodiment is suitably used in such cases.

As shown in FIG. 7, the top surface 23 is a flat surface 24 and is sloped or oriented at such an angle that the light projected from the light emitting diode 15 toward the top surface 23 is reflected on the flat surface 24 and is redirected toward the first surface 29 of the cap 22*b* and is prevented to be directed toward the second surface 30. Each of the light source devices 20*b* is disposed in the globe 3 so that a light from the first surface 29 of each of the light source devices 20*b* is projected outwardly from the globe 3 through the light-permeable first wall 5*a* and is prevented to be projected from the second wall 5*b*. Thus, by a mere substitution of the caps 22*b* for the caps 22*a* of FIG. 4, it is possible to change the illumination mode while retaining the construction of the globe as is. In the second embodiment, the brightness of the light from the globe 3 is much increased.

In the second embodiment, each of the third and fourth surfaces 25, too, is oriented to form a sloped surface 26 as shown in FIG. 8, so that light from the diode 15 projected toward the third and fourth surfaces 25 is reflected on the sloped surface 26 and is redirected toward the first surface 29. Depending upon the angle of orientation of the third and fourth surfaces 25, the second surface 30 therebetween is narrowed and is ultimately a ridge at which the third and fourth surfaces 25 intersect, as shown in FIGS. 6 and 8.

Figure 9:
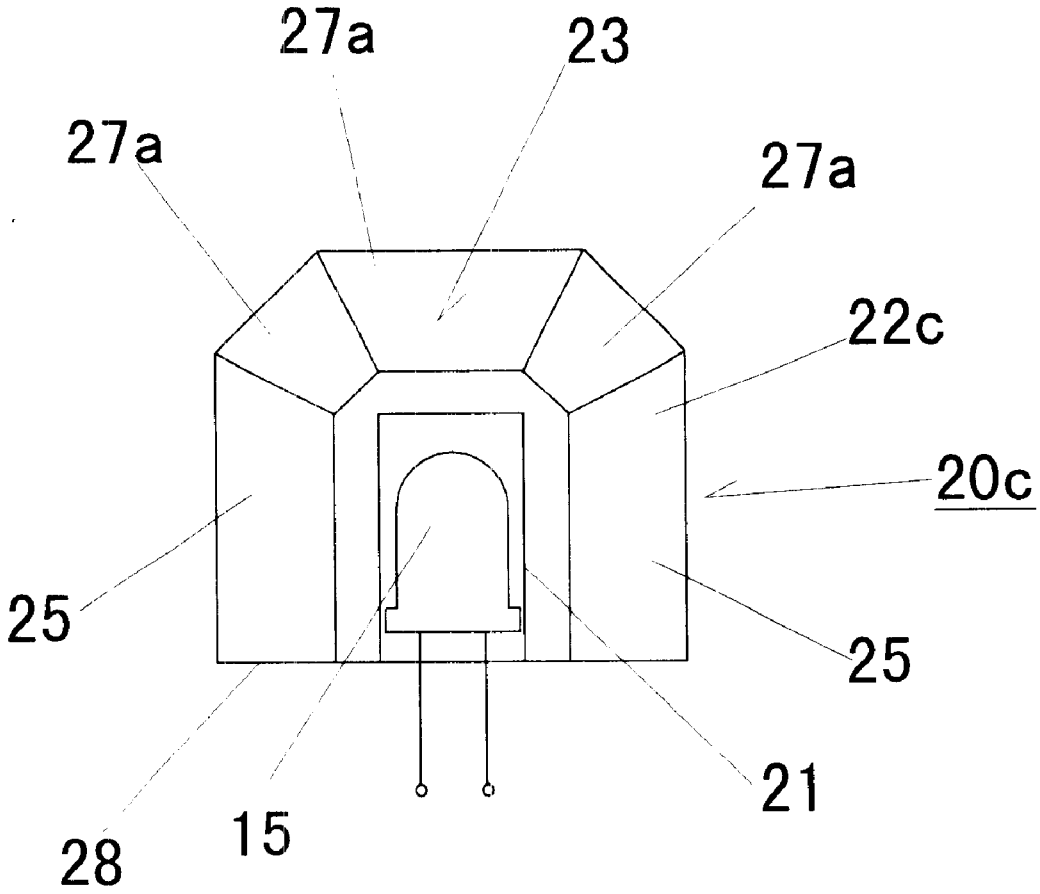
FIG. 9 is an elevational view, similar to FIG. 3, showing a third embodiment of a light source device according to the present invention.
Figure 10:
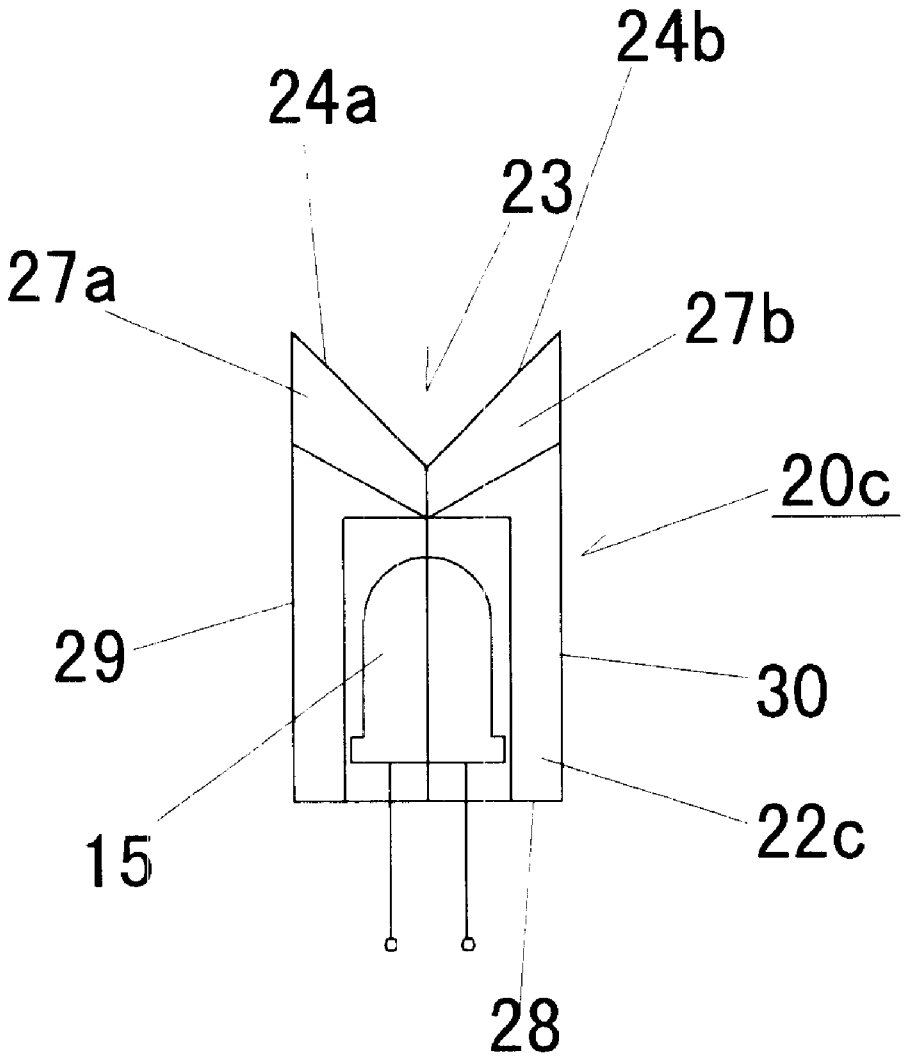
FIG. 10 is a side view of the light source device of FIG. 9.

FIGS. 9 and 10 depict a third embodiment of the light source device 20*c*, in which the same reference numerals as those in FIGS. 3 through 5 designate similar component parts. The light source device 20*c* of the third embodiment differs from the first embodiment in shape of the top surface 23.

Namely, the top surface 23 of the cap 22*c* is V-shaped and is composed of two sloped surfaces 22*a* and 24*b*, similar to the first embodiment. However, the sloped surface 22*a* in this embodiment has both side end portions 27*a*, 27*a* outwardly spread. Similarly, the sloped surface 24*b* has outwardly spread portions 27*b*, 27*b* at both ends. As a result, the light projected from the light emitting diode 15 toward the surfaces 27*a* and 27*a* is reflected thereon and redirected toward the first surface 29, while the light projected from the light emitting diode 15 toward the surfaces 27*b* and 27*b* is reflected thereon and redirected toward the second surface 30.

Figure 11:
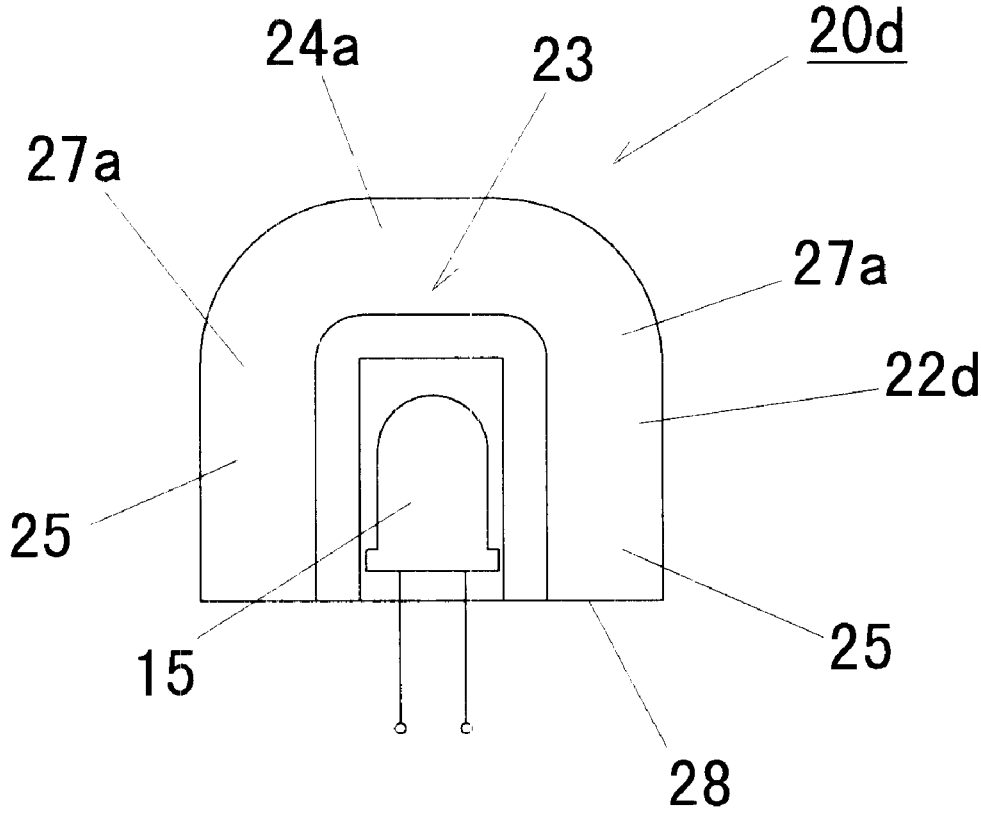
FIG. 11 is an elevational view, similar to FIG. 9, showing a fourth embodiment of a light source device according to the present invention.
Figure 12:
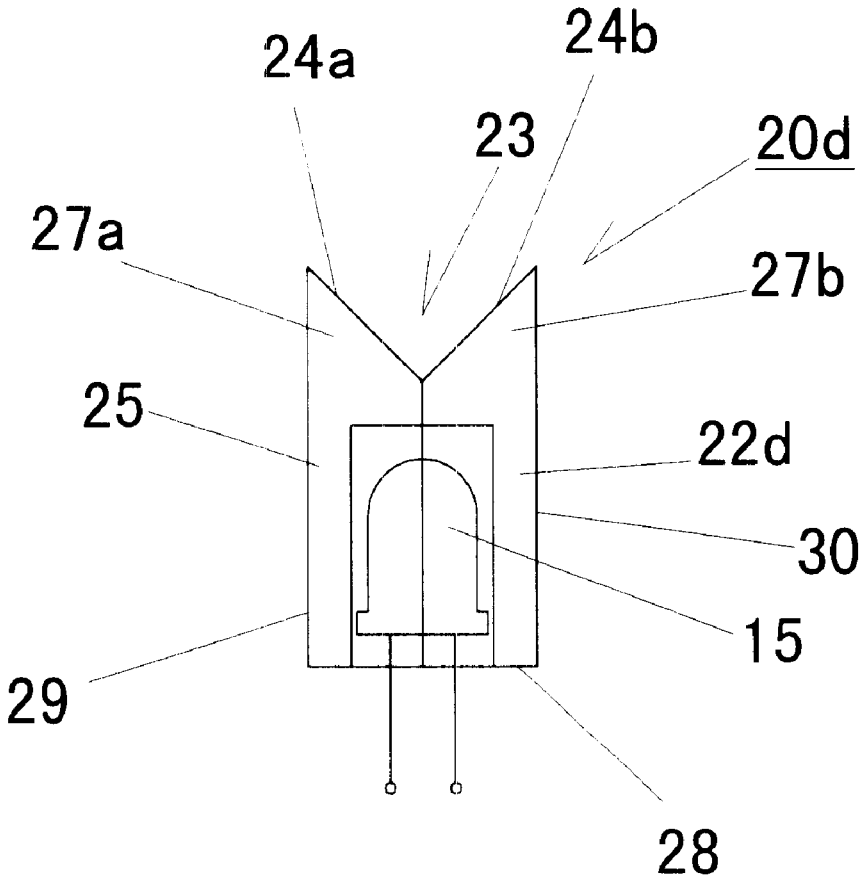
FIG. 12 is a side view, similar to FIG. 10, of the light source device of FIG. 11.

FIGS. 11 and 12 depict a fourth embodiment of the light source device 20*d*, in which the same reference numerals as those in FIGS. 9 and 10 designate similar component parts. The light source device 20*d* of the fourth embodiment differs from the third embodiment in shape of the top surface 23.

Namely, the top surface 23 of the cap 22d is V-shaped and is composed of two sloped surfaces 22*a* and 24*b*, similar to the third embodiment. However, the sloped surface 22*a* in this embodiment has both side end portions 27*a*, 27*a* smoothly curved and outwardly spread. Similarly, the sloped surface 24*b* has smoothly curved, outwardly spread portions 27*b*, 27*b* at both ends. As a result, the light projected from the light emitting diode 15 toward the surfaces 27*a* and 27*a* is reflected thereon and redirected toward the first surface 29, while the light projected from the light emitting diode 15 toward the surfaces 27*b* and 27*b* is reflected thereon and redirected toward the second surface 30.

Figure 13:
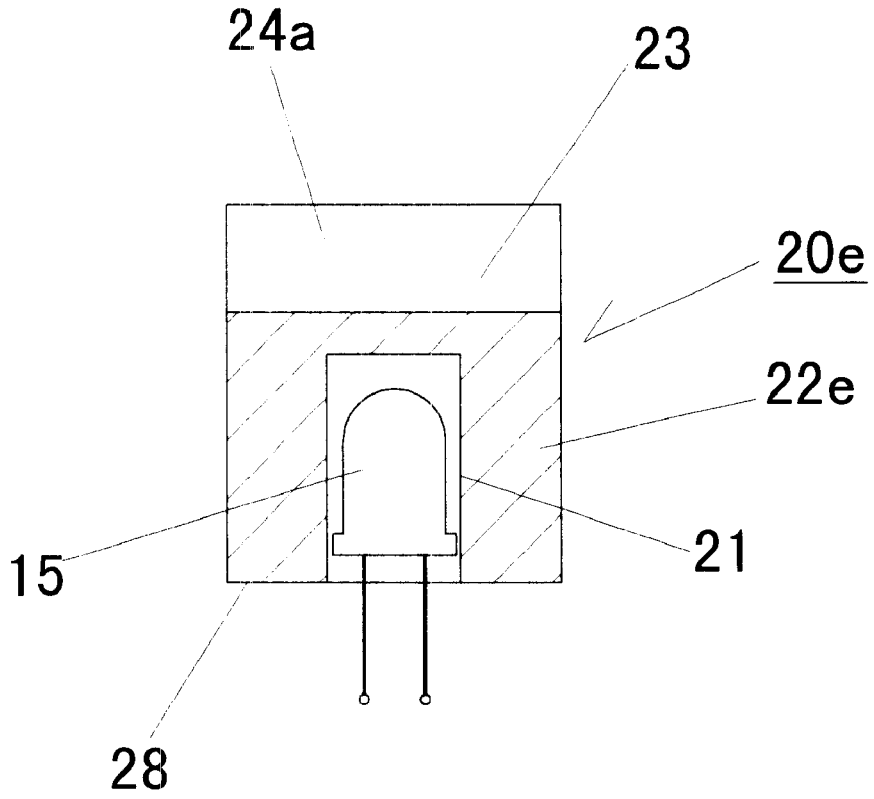
FIG. 13 is an elevational view, similar to FIG. 11, showing a fifth embodiment of a light source device according to the present invention.
Figure 14:
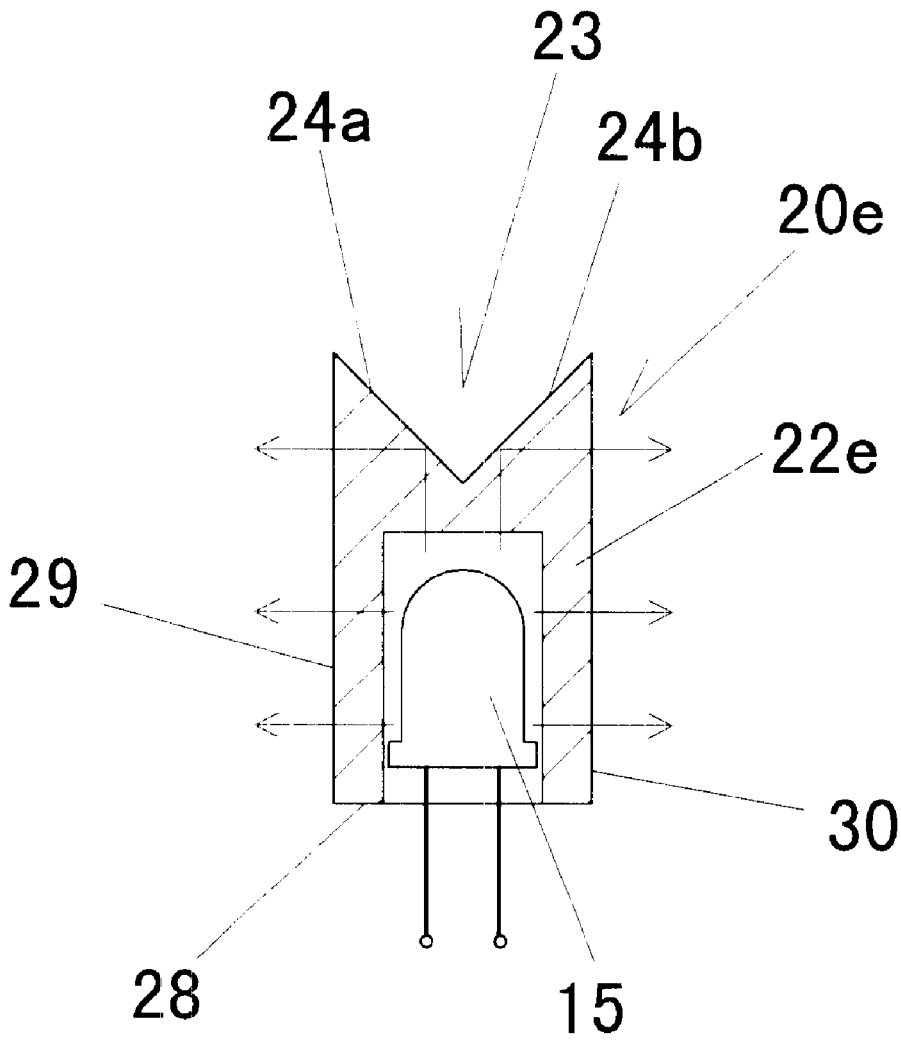
FIG. 14 is a sectional view, similar to FIG. 4, of the light source device of FIG. 13.

FIGS. 13 and 14 depict a sixth embodiment of the light source device 20*e*, in which the same reference numerals as those in FIGS. 3 through 5 designate similar component parts. The light source device 20*e* of the fifth embodiment has the simplest structure and differs from the first embodiment in that the third and fourth surfaces 25 are not V-shaped but are parallel flat surfaces.

In the light emitting device 1 described above, the number and color of the light source devices 20*a* may be changed and selected at will according to the object of the end use. A lot of desired colors are obtainable by use of colored caps 22*a*–22*e* in combination with the colors of the light emitting diodes 15. Further, the size and color of the light source can be easily changed by changing the caps 22*a*–22*e* without changing the light emitting diodes 15. Additionally, by electrically connecting the light emitting diodes 15 to a suitable known control circuit or a switching circuit, it is possible to selectively light the light source devices according to a programmed sequence or an intended design (including color and pattern) on the globe.

Figure 15:
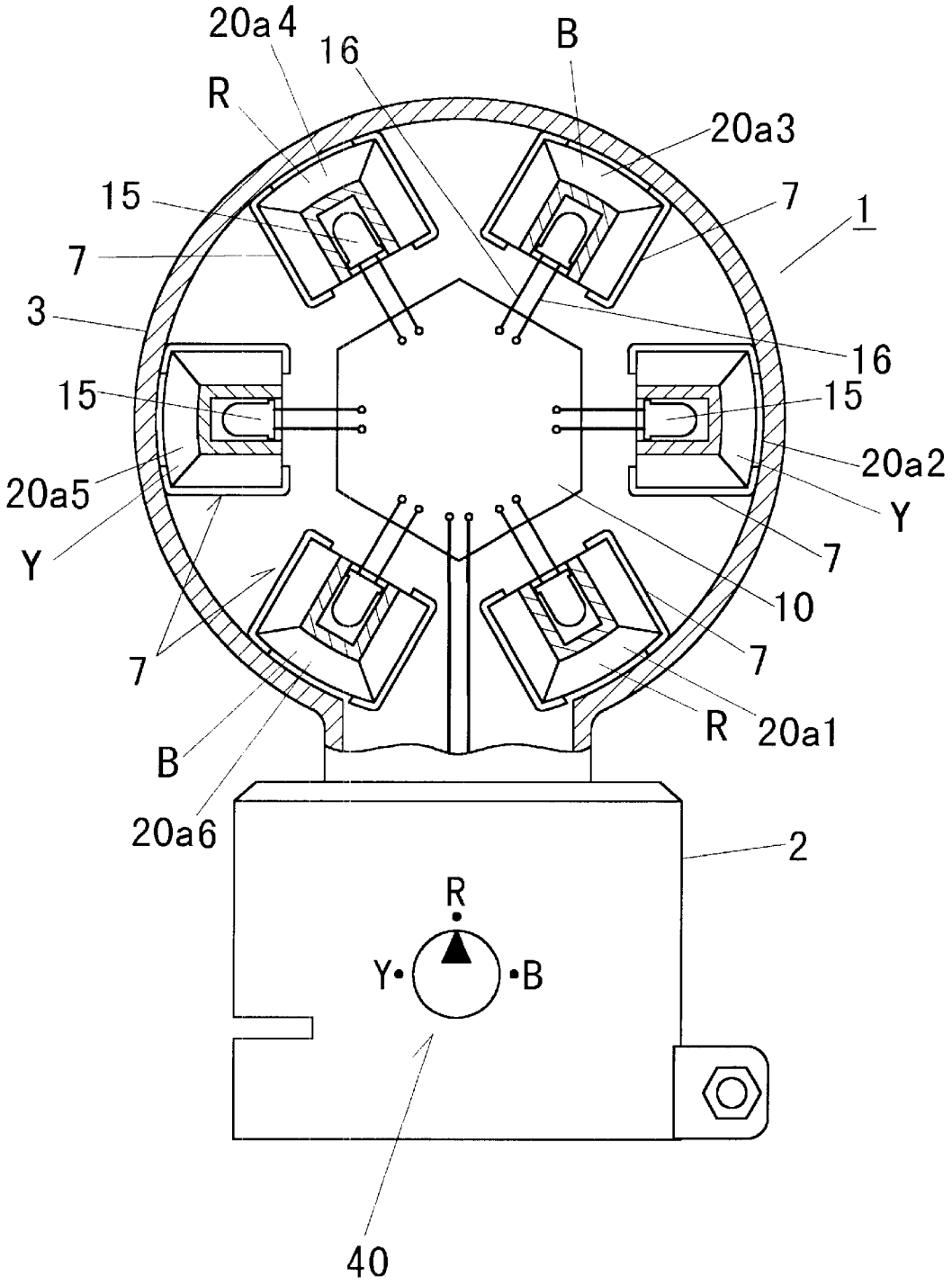
FIG. 15 is an elevational view, similar to FIG. 1, showing an embodiment of a light emitting device according to the present invention.

Examples of such indication or illumination will be described next with reference to FIG. 15 having six light source devices 20*a*1 through 20*a*6. In this embodiment, the devices 20*a*1 and 20*a*4 are red (R), 20*a*2 and 20*a*5 are yellow (Y) and 20*a*3 and 20*a*6 are blue (B).

In the simplest case, all the light source devices 20*a*1 through 20*a*6 are simultaneously energized to show a pattern having mixed colors on one side or both sides of the glove 3. By changing the number, position, size and color of the light source devices, various patterns may be created.

Alternatively, by successively energizing the light source devices 20*a*1 through 20*a*6 one by one, a pattern lights as if moving or running along a circle. Such a moving sign may also be obtained by successively making the devices 20*a*1–20*a*6 OFF. Similarly, by selectively making the devices 20*a*1 through 20*a*6 ON and OFF repeatedly, a moving sign or pattern may be also obtained. These moving patterns are attractive and are effective for advertising.

In the light emitting device acting as a signal indicating lamp, selective light source device or devices are energized. Thus, in the case of the embodiment of FIG. 15, a selection switch 40, such as a dial switch or a slide switch, is provided on a mounting bracket 2 to selectively energize red lamps (indicating, for example, dangerous condition), blue lamps (indicating, for example, safe condition) or yellow lamps (indicating, for example, need of caution) . The signal indicating lamp may be used as a traffic sign, a parking sign, a workplace sign, etc. The signal indication lamp may be automatically operated in combination with a sensor (e.g. temperature sensor, light sensor, moisture sensor, gas sensor, weight sensor, etc.) or any suitable command supplying automatic control device.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. H10-317555, filed Nov. 9, 1998 and No. 2000-51047, filed Feb. 28,2000, inclusive of the specification, claims and drawings, are hereby incorporated by reference herein.

What is claimed is:

1. A light emitting device comprising:

a disc-like globe including a light permeable first wall, a second wall disposed opposite said first wall, and a circumferential side wall disposed between said first and second walls, and a plurality of light source devices secured within said globe and arranged along a peripheral portion thereof, each of said light source devices comprising:

a light-permeable cap having opposing top and bottom surfaces, opposing first and second surfaces located between said top and bottom surfaces, opposing third and fourth surfaces located between said top and bottom surfaces and between said first and second surfaces, said bottom surface having a concave portion extending toward said top surface; and a light emitting diode accommodated and secured in said concave portion so that a part of light emitted from said diode is projected toward said top surface;

said top surface being a flat surface oriented at such an angle that the light projected toward said top surface is reflected thereon and is redirected toward said first surface, each of said light source devices being disposed so that a light from said first surface of each of said light source devices is projected outwardly from said globe through said light-permeable first wall.

2. A light emitting device as claimed in claim 1, wherein each of said third and fourth surfaces of each of said light source devices is a flat surface oriented so that light from said diode projected toward said third and fourth surfaces is reflected thereon and is redirected toward said first surface.

3. A light emitting device as claimed in claim 1, wherein said light permeable caps are colored so that light images having various colors and patterns are formed on each of said first and second walls of said globe.

4. A light emitting device as claimed in claim 3, further comprising control means for selectively lighting said light source devices.

5. A light emitting device as claimed in claim 4, wherein said control means includes switching means for selectively lighting said light source devices.

6. A light emitting device as claimed in claim 4, wherein said control means includes means for selectively lighting said light source devices according to a programmed sequence.

7. A light emitting device comprising:

a disc-like globe including opposing light permeable first and second walls, and a circumferential side wall disposed between said first and second walls, and a plurality of light source devices secured within said globe and arranged along a peripheral portion thereof, each of said light source devices comprising:

a light-permeable cap having opposing top and bottom surfaces, opposing first and second surfaces located between said top and bottom surfaces, opposing third and fourth surfaces located between said top and bottom surfaces and between said first and second surfaces, said bottom surface having a concave portion extending toward said top surface; and a light emitting diode accommodated and secured in said concave portion so that a part of light emitted from said diode is projected toward said top surface;

said top surface being V-shaped so that the light projected toward said top surface is reflected thereon and divided into two fractions which are redirected toward said first and second surfaces, respectively, each of said light source devices being disposed so that the light fractions from said first and second surfaces of each of said light source devices are projected outwardly from said globe through said light-permeable first and second walls, respectively.

8. A light emitting device as claimed in claim 7, wherein each of said third and fourth surfaces of each of said light source devices is V-shaped so that light from said diode projected toward said third and fourth surfaces is reflected thereon and is divided into two light fractions which are redirected toward said first and second surfaces, respectively.

9. A light emitting device as claimed in claim 7, wherein said light permeable caps are colored so that light images having various colors and patterns are formed on each of said first and second walls of said globe.

10. A light emitting device as claimed in claim 9, further comprising control means for selectively lighting said light source devices.

11. A light emitting device as claimed in claim 10, wherein said control means includes switching means for selectively lighting said light source devices.

12. A light emitting device as claimed in claim 10, wherein said control means includes means for selectively lighting said light source devices according to a programmed sequence.

13. A light source device comprising: a light permeable cap having opposite top and bottom surfaces, opposing first and second surfaces located between said top and bottom surfaces, opposing third and fourth surfaces located between said top and bottom surfaces, said bottom surface having a concave portion extending toward said top surface; and a light emitting diode accommodated and secured in said concave portion so that part of the light emitted from said diode is projected toward said top surface;

said top surface being V-shaped so that the light projected toward said top surface is reflected thereon and divided into two fractions which are redirected toward said surfaces respectively.

14. A light source device as claimed in claim 13, wherein each of said third and fourth surfaces is oriented so that light from said diode projected toward said third and fourth surfaces is reflected thereon and redirected toward said first and second surfaces, respectively.

* * * * *